US008202067B2

(12) United States Patent
Klein et al.

(10) Patent No.: US 8,202,067 B2
(45) Date of Patent: Jun. 19, 2012

(54) OIL PUMP FOR A REFRIGERATING COMPRESSOR

(75) Inventors: Fabio Henrique Klein, Joinville (BR); Luiz Fabiano Jovita, Joinville (BR); Andrea Lopes, Joinville (BR)

(73) Assignee: Whirlpool S.A., Sao Paulo-Sp (BR)

( * ) Notice: Subject to any disclaimer, the term of this patent is extended or adjusted under 35 U.S.C. 154(b) by 242 days.

(21) Appl. No.: 12/447,756

(22) PCT Filed: Oct. 24, 2007

(86) PCT No.: PCT/BR2007/000290

§ 371 (c)(1),
(2), (4) Date: Apr. 29, 2009

(87) PCT Pub. No.: WO2008/052297

PCT Pub. Date: May 8, 2008

(65) Prior Publication Data

US 2010/0074771 A1 Mar. 25, 2010

(30) Foreign Application Priority Data

Oct. 31, 2006 (BR) ..... 0604908

(51) Int. Cl.
*F04B 37/14* (2006.01)

(52) U.S. Cl. ..... 417/410.3; 417/366; 417/372

(58) Field of Classification Search ..... 417/366, 417/363, 902, 410.3, 372, 423.13; 184/6.16, 184/6.18; 415/111, 113, 175, 176
See application file for complete search history.

(56) References Cited

U.S. PATENT DOCUMENTS

| | | | |
|---|---|---|---|
| 6,450,785 | B1 | 9/2002 | Dellby et al. |
| 2002/0172607 | A1 | 11/2002 | Kim |

FOREIGN PATENT DOCUMENTS

| | | |
|---|---|---|
| EP | 0728946 | 8/1996 |
| WO | WO-93/22557 | 11/1993 |
| WO | WO-96/29516 | 9/1996 |
| WO | WO-03/012297 | 2/2003 |
| WO | WO-2005/047699 | 5/2005 |

*Primary Examiner* — Joseph L Williams

(74) *Attorney, Agent, or Firm* — Gifford, Krass, Sprinkle, Anderson & Citkowski, P.C.

(57) ABSTRACT

Oil pump for hermetic refrigerating compressor comprising a tubular sleeve having an upper portion affixed to at least one of the parts of crankshaft and rotor, and a lower portion having a lower end immersed in the lubricant oil, said tubular sleeve being provided with an inner surface presenting, along at least part of its longitudinal extension, at least one helical groove upwardly extending from the lower end; and a pump body disposed inside the tubular sleeve and defining, with the adjacent helical groove of the tubular sleeve, a lubricant oil ascending channel, said pump body presenting a lower end portion mounted to one of the parts of shell, cylinder block and stator, so as to be freely displaced within the tubular sleeve, in radial directions orthogonal to the crankshaft and rotatively locked in relation to the rotor.

33 Claims, 10 Drawing Sheets

OIL PUMP FOR A REFRIGERATING COMPRESSOR

This application is a US National Phase Application under 35 U.S.C. §371 of International Patent Application No. PCT/BR2007/000290 filed Oct. 24, 2007, which claims priority to and the benefit of Brazilian Patent Application No. PI0604908-7, filed Oct. 31, 2006, each of which are hereby incorporated by reference in their entireties. The International Application published as WO 2008/052297 Al on May 8, 2008.

FIELD OF THE INVENTION

The present invention refers to an oil pump for a refrigerating compressor of the type which comprises, in the interior of a hermetic shell, a motor which carries a crankshaft having an upper end for driving a refrigerant gas pumping mechanism of the compressor, and a lower end carrying an oil pump immersed in a lubricant oil contained in an oil reservoir defined in the interior of the shell.

BACKGROUND OF THE INVENTION

An important factor for the adequate operation of most refrigerating compressors is the adequate lubrication of the components thereof which have a relative movement between each other. The lubrication is obtained by pumping lubricant oil provided in an oil reservoir defined in the interior of a generally hermetic shell of said compressors, in a lower portion of said shell. This oil is pumped until reaching the parts with relative movement of the compressor, wherefrom said oil returns, for example, by gravity, to the oil reservoir.

In some known constructions, the compressor comprises a generally vertical crankshaft that carries a lubricant oil pump, which conducts said oil to the compressor parts to be lubricated, using the rotation of said crankshaft. In these constructions, the oil is pumped from the oil reservoir by spinning and mechanical dragging.

In this constructions, the crankshaft presents a portion of its extension provided, externally (WO2005/047699) or internally (WO96/29516), with helical grooves which conduct the lubricant oil from the oil reservoir to the relatively moving parts of the compressor distant from the oil reservoir.

In the solution WO2005/047699, a tubular sleeve is provided around part of the crankshaft which presents the helical grooves, said tubular sleeve being attached to the compressor shell or to the stator.

The solution WO96/29516 presents the crankshaft having part of its extension defining a conduct inside which is mounted, with a radial gap, a pump body, said solution presenting one of the parts of inner wall of the tubular shaft and outer wall of the pump body provided with helical grooves.

There are known some prior art solutions for oil pumping in variable speed compressors. In these constructions (WO93/22557, U.S. Pat. No. 6,450,785), the crankshaft inferiorly carries a pump body provided with surface channels and which is internally disposed in a tubular sleeve, one of the parts of pump body and tubular sleeve being rotatively stationary in relation to the other part, so as to allow a dragging effect on the oil being pumped by centrifugal force, resulting from the rotation of the motor.

Solution WO93/22557 presents the pump body, which is externally provided with helical grooves, affixed to the crankshaft, in order to rotate therewith, the tubular sleeve being attached to the electric motor, by a fixation rod, said tubular sleeve being mounted around the pump body with a radial gap.

This solution allows friction wear to occur between the parts of pump body and tubular sleeve, as well as mechanical losses, as a result of the rigid fixation between said tubular sleeve and the stator and of practically inevitable misalignments between the pump body and the tubular sleeve.

Solution U.S. Pat. No. 6,450,785 presents the pump body externally provided with helical grooves on its outer surface and inferiorly attached to the electric motor stator through a fixation rod with a "U"-shaped profile, and the tubular sleeve affixed to the crankshaft of the compressor, so as to rotate therewith. This solution presents a construction in which the fixation rod allows only a certain angular movement of the pump body around axes contained in the lower fixation plane of the pump body to the fixation rod, said plane being orthogonal to the crankshaft of the compressor. Thus, the fixation rod can be elastically deformed to permit the pump body to incline to accommodate itself in the interior of the tubular sleeve. However, as the pump body is not free to be displaced, in its entirety, in directions orthogonal to the crankshaft, it is not able to compensate for construction or mounting misalignments, so as to occupy a position in which its axis is concentric or parallel to the axis of the tubular sleeve.

Although reducing the friction wear and losses, this known prior art solution U.S. Pat. No. 6,450,785 also conducts to a certain efficiency loss, particularly considering the inevitable dimensional deviations of manufacture and mounting.

OBJECTS OF THE INVENTION

It is an object of the present invention to provide an oil pump for a refrigerating compressor, which guarantees an adequate lubrication of the compressor parts with relative movement, even in low rotation speeds.

Another object of the present solution is to provide an oil pump such as cited above, whose construction minimizes the problems regarding wear and increase in the consumption of the parts which compose said oil pump and subjected to concentricity loss and friction.

It is a further object to provide an oil pump such as cited above, which does not need accuracy for its construction and assembly.

Another object of the present invention is to provide an oil pump such as cited above, which has a reduced cost and easy construction.

SUMMARY OF THE INVENTION

The objects cited above, as well as other objects of the present invention, are achieved by the provision of an oil pump for a refrigerating compressor presenting a shell defining, in its interior, an oil reservoir containing lubricant oil and carrying a cylinder block affixing the stator of a motor provided with a rotor which rotates a crankshaft carrying, in a lower end, an oil pump immersed in the lubricant oil, said oil pump comprising: a tubular sleeve, having an upper portion affixed to at least one of the parts of crankshaft and rotor, so as to rotate therewith, and a lower portion having a lower end immersed in the lubricant oil, said tubular sleeve being provided with an inner surface presenting, along at least part of its longitudinal extension, at least one helical groove extending upwardly from the lower end; an elongated pump body disposed in the interior of the tubular sleeve, maintaining a certain radial gap in relation thereto and having an outer surface defining, with the adjacent helical groove of the tubular sleeve, a lubricant oil ascending channel, said pump body presenting a lower end portion projecting beyond the lower end of the tubular sleeve and through which said pump body is mounted to one of the parts of shell, of cylinder block and stator, to be freely displaced in the interior of the tubular sleeve, in radial directions orthogonal to the crankshaft and rotatively locked in relation to the rotor.

BRIEF DESCRIPTION OF THE DRAWINGS

The invention will be described below with reference to the enclosed drawings, given by way of example of an embodiment of the invention and in which.

DESCRIPTION OF THE ILLUSTRATED EMBODIMENTS

Figure 1:
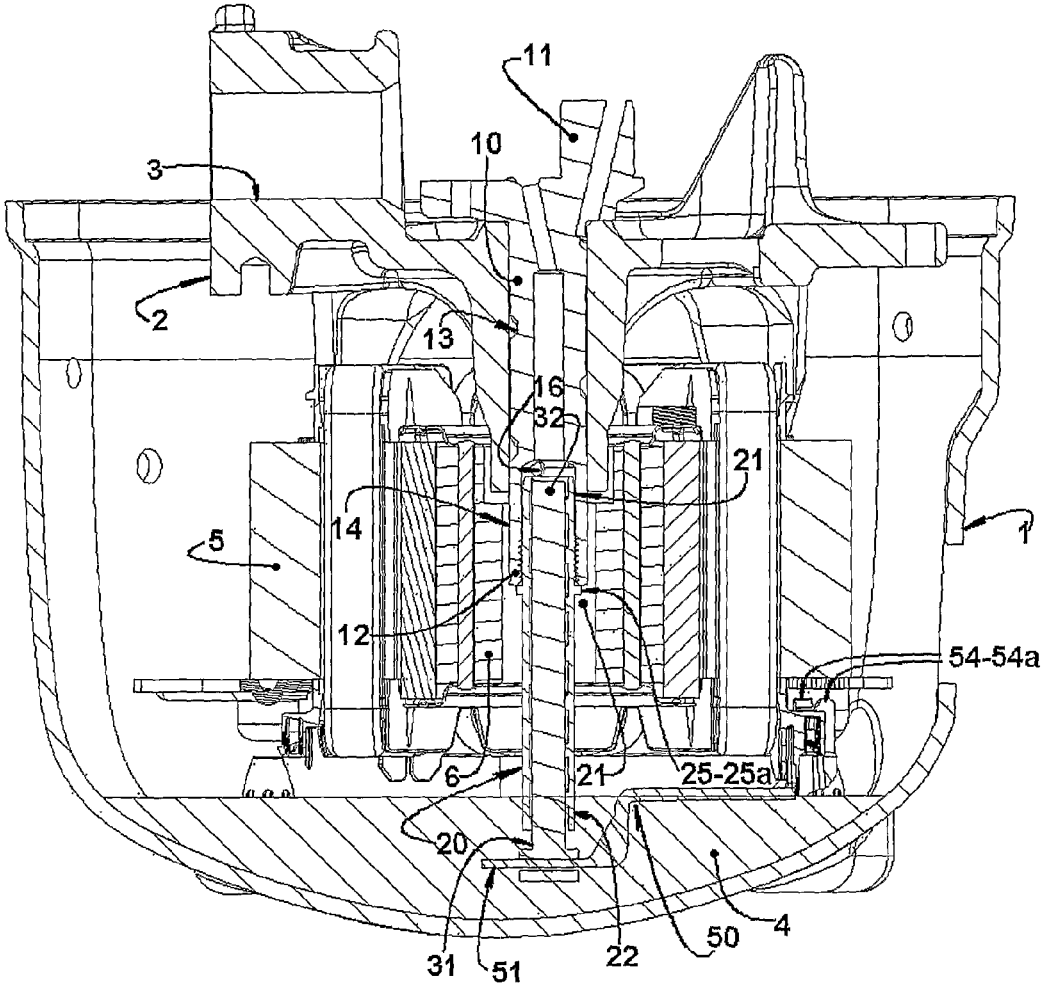
FIG. 1 represents a schematic longitudinal sectional view of a refrigerating compressor with a vertical shaft, said compressor presenting a crankshaft which inferiorly carries an oil pump constructed according to the present invention, partially immersed in the oil of an oil reservoir defined in a lower portion of the shell of said compressor.
Figure 2:
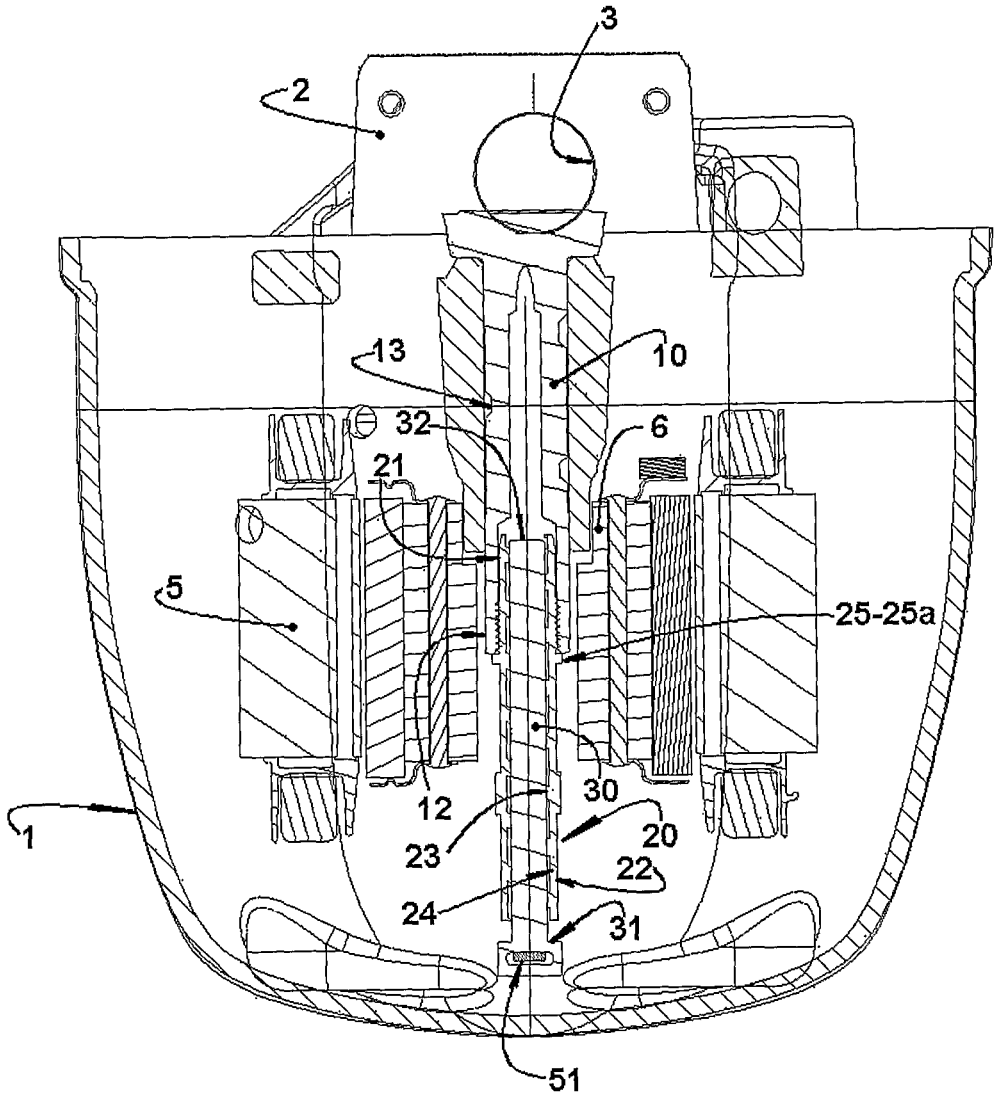
FIG. 2 represents a schematic view, such as the one of FIG. 1, but offset in 90 degrees therefrom.
Figure 4:
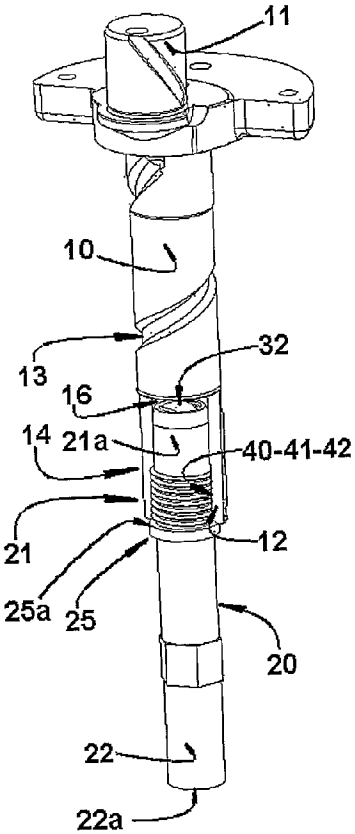
FIG. 4 represents a schematic perspective view of the crankshaft securing the tubular sleeve of the pump of the present invention, illustrating, in a partial longitudinal section, the crankshaft region in which the tubular sleeve is mounted.
Figure 3:
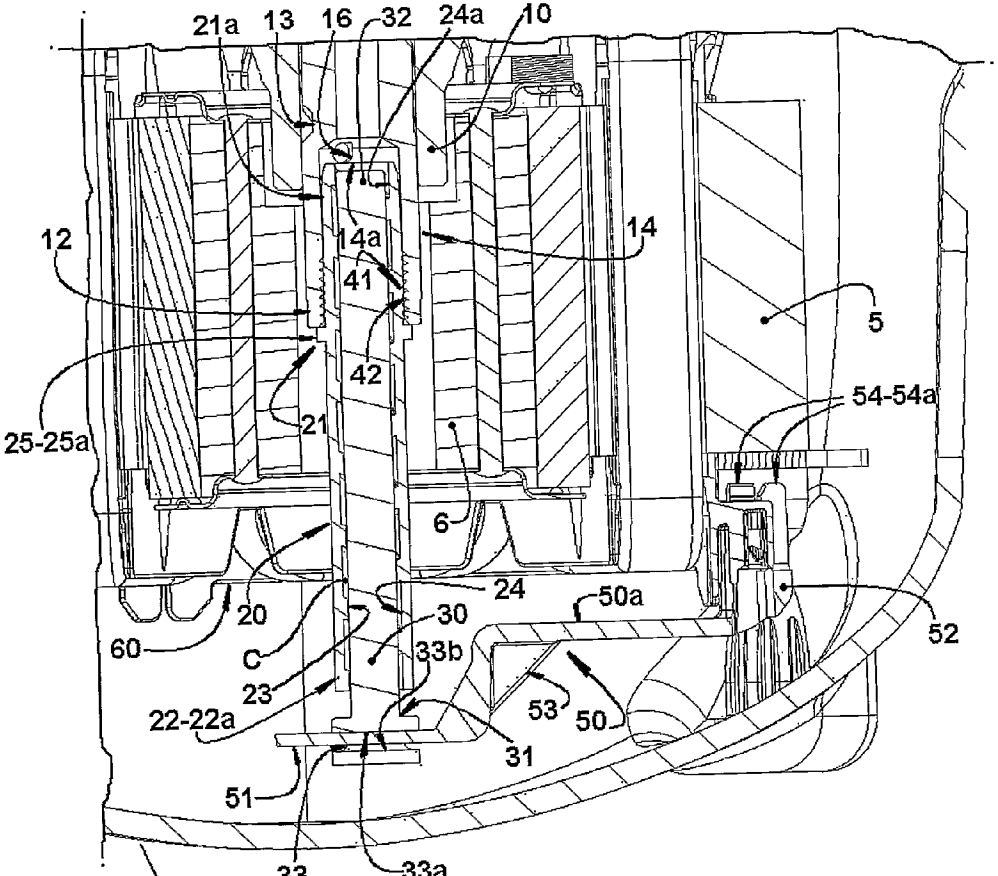
FIG. 3 represents a schematic enlarged view of the crankshaft region in which is mounted the oil pump of the present invention, such as illustrated in FIG. 1.
Figure 6:
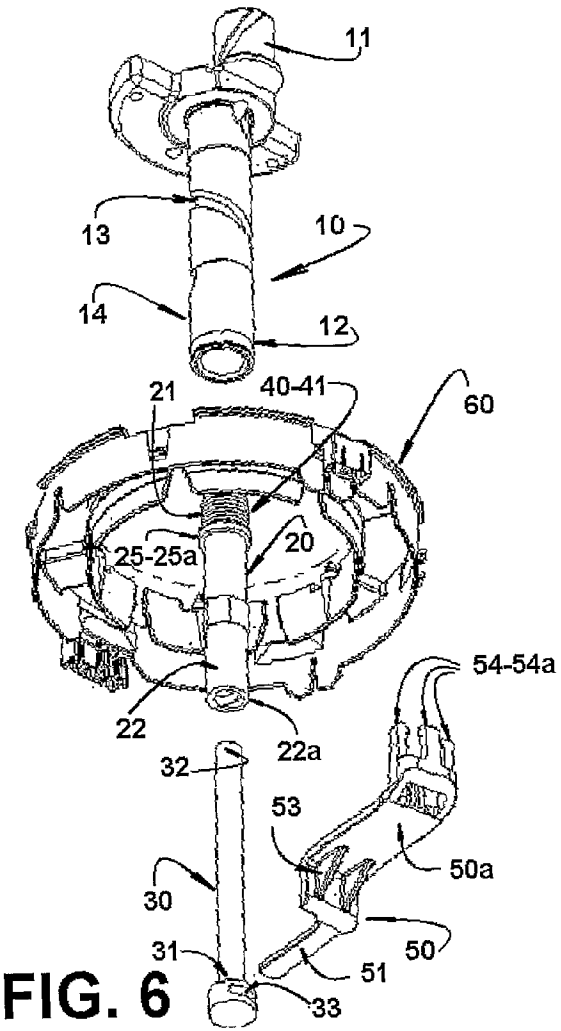
FIG. 6 represents a schematic lower exploded perspective view of the crankshaft, a stator cover, the component parts of the oil pump of the present invention, and a fixation means for securing said oil pump to the stator.
Figure 5:
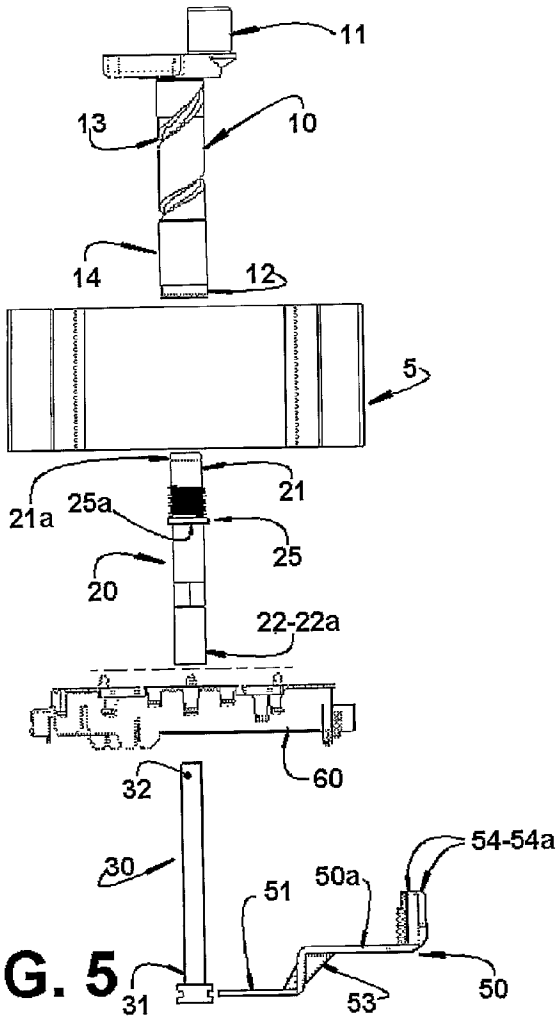
FIG. 5 represents a schematic exploded side view of the crankshaft, of the electric motor and of the component parts of the oil pump of the present invention.
Figure 7:
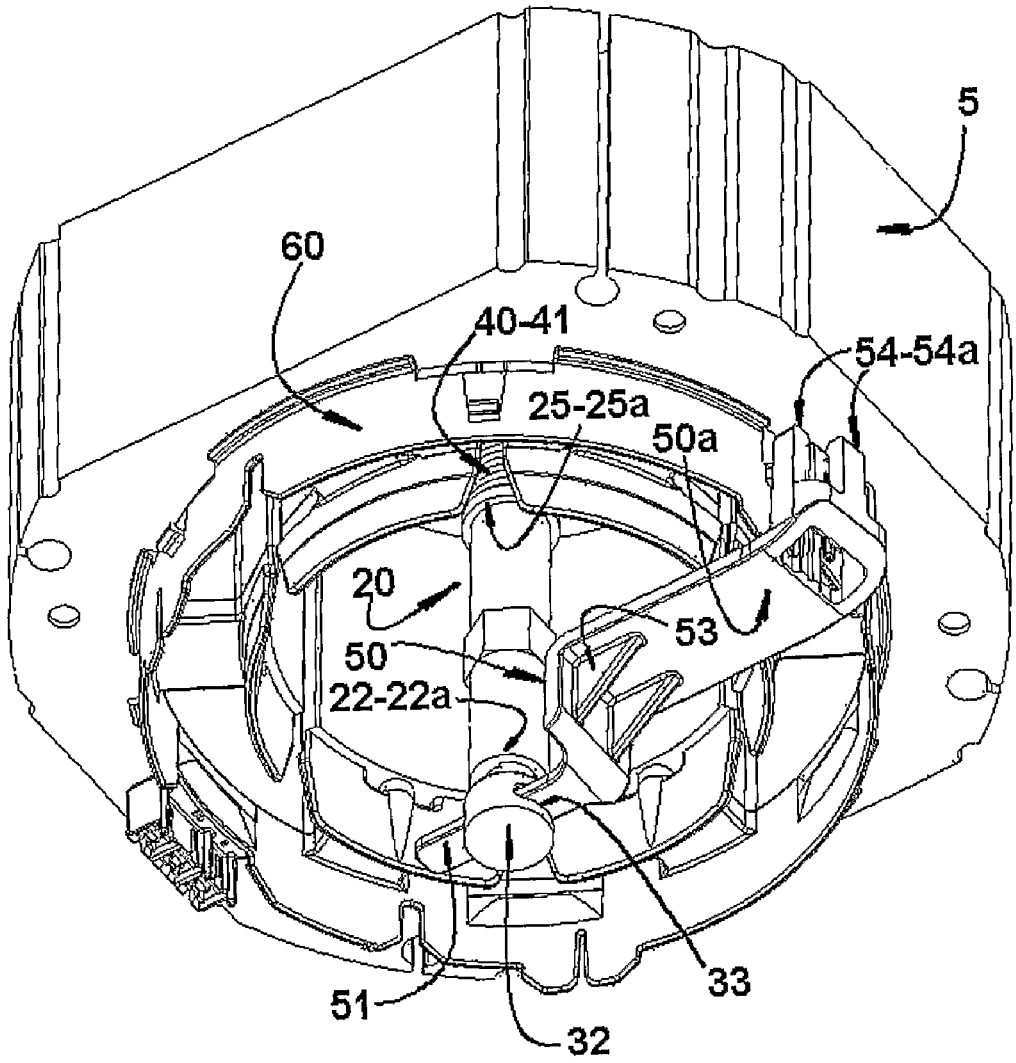
FIG. 7 represents a schematic lower perspective view of the electric motor stator and of the oil pump of the present invention affixed thereto.
Figure 8:
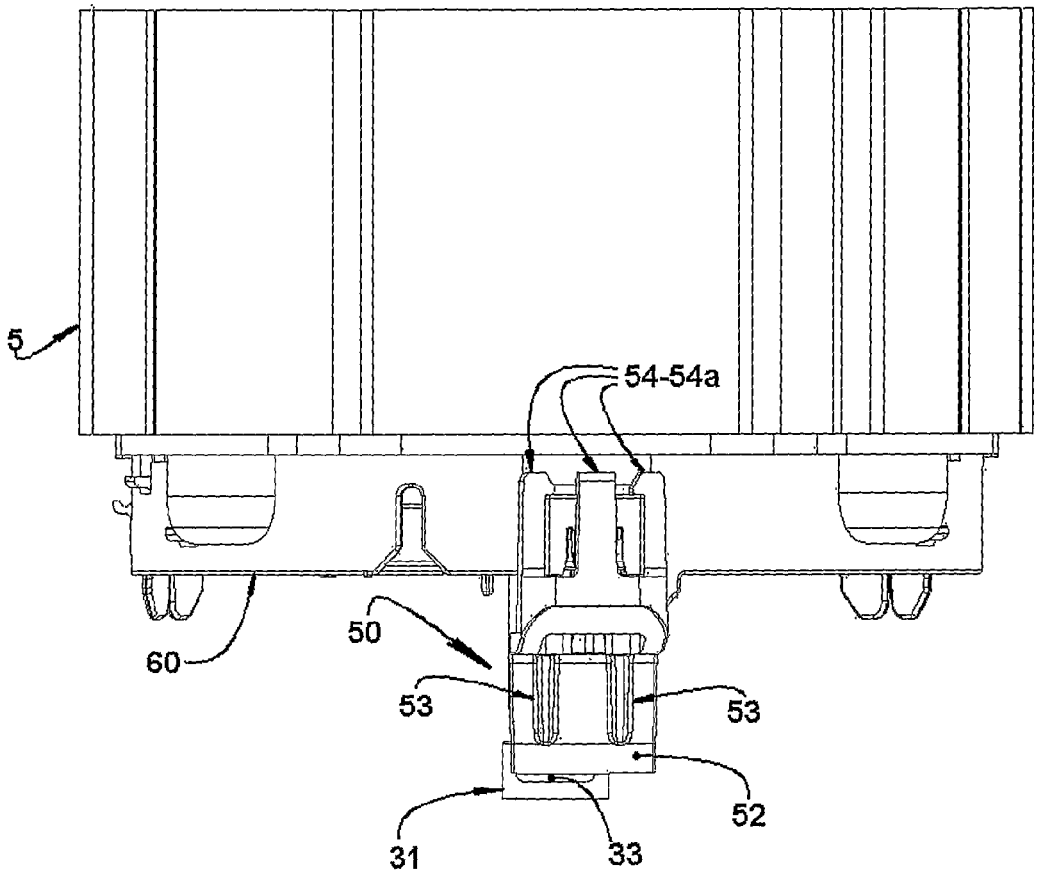
FIG. 8 represents a schematic side view of the motor, taken from the region in which the pump body of the oil pump of the present invention is affixed to the stator.

The present invention will be described for a reciprocating hermetic compressor (for example, of the type applied to a refrigerating system) presenting a generally hermetic shell 1, housing a cylinder block 2 which defines a cylinder 3 within which actuates a reciprocating piston (not illustrated), in a lower portion of the shell 1 being defined an oil reservoir 4, wherefrom the oil that lubricates the movable parts of the compressor is pumped through an oil pump.

In the present construction described herein, the refrigerating compressor is of the type which is driven by a crankshaft 10, which moves the piston, said crankshaft 10 superiorly presenting an eccentric portion 11 journalled to the cylinder block 2 and carrying, in a lower end 12, the oil pump of the present invention, which is operatively affixed to the rotor 6, so as to rotate therewith, and presents a lower portion immersed in the lubricant oil contained in the oil reservoir 4, and an upper portion which maintains fluid communication with a helical external oil channel 13 provided in the crankshaft 10 and which takes the oil pumped by the oil pump to the compressor parts to be lubricated.

The cylinder block 2 secures a stator 5 of an electric motor, further including a rotor 6 attached to the crankshaft 10, so as to rotate the latter upon operation of the motor.

According to the present invention, the oil pump comprises: a tubular sleeve 20, having an upper portion 21 affixed to at least one of the parts of crankshaft 10 and rotor 6, so as to rotate therewith, and a lower portion 22 having a lower end 22*a* immersed in the lubricant oil, said tubular sleeve 20 being provided with an inner surface 23 in which is provided, along at least part of its longitudinal extension, at least one helical groove 24 upwardly extending from the lower end 22*a*.

The oil pump of the present invention further comprises an elongated pump body 30 disposed in the interior of the tubular sleeve 20, so that an outer surface of the pump body 30 maintains a certain radial gap in relation to an adjacent confronting inner surface of the tubular sleeve 20, said pump body 30 having a lower end portion 31, projecting beyond the lower end 22*a* of the tubular sleeve 20, to be affixed to at least one of the parts of shell 1, cylinder block 2, and stator 5.

The tubular sleeve 20 is coupled to at least one of the parts of rotor 6 and crankshaft 10, so as to be rotatively driven with the part that carries it, upon rotation of the rotor 6, said movement being provoked by operation of the electric motor, whilst the pump body 30 remains rotatively fixed. The relative movement between the tubular sleeve 20 and the pump body 30 makes the oil flow upwardly from the oil reservoir 4, by mechanical dragging and centrifugal force.

In a way of carrying out the present invention, at least the tubular sleeve 20, in permanent contact with said crankshaft 10, is provided in plastic material.

In a particular constructive form, the tubular sleeve 20 and the pump body 30 are provided, for example, in plastic material.

The construction of the tubular sleeve 20 and pump body 30 in plastic material facilitates the manufacture of these components. Moreover, the manufacture in plastic material also minimizes the heat transfer from the crankshaft 10 to the oil being pumped, due to the low thermal conductivity of said material.

In one of the illustrated constructions (FIGS. 1-8 and 10-12), the tubular sleeve 20 and the pump body 30 present a constant circular cross-section along the respective longitudinal extension. However, it should be understood that other constructions are possible within the concept presented herein, such as a variable oblong cross-sectional construction for said parts of tubular sleeve and pump body.

Figure 9:
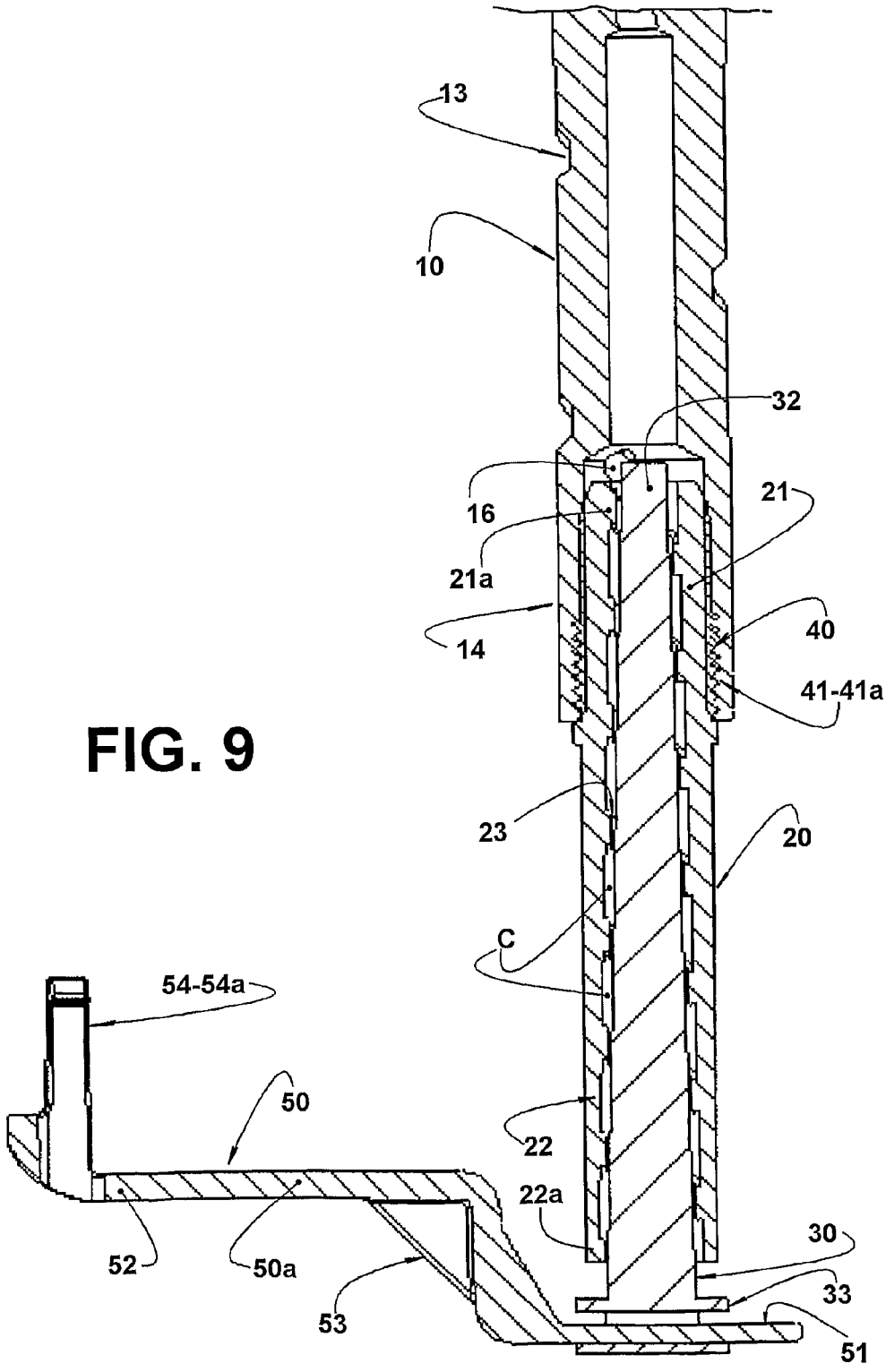
FIG. 9 represents a schematic longitudinal sectional view of a crankshaft securing an oil pump constructed according to the present invention, for a construction in which the tubular sleeve and pump body presents confronting conic surfaces.

In another way of carrying out the present invention illustrated in FIG. 9, the parts of tubular sleeve 20 and pump body 30 present a circular cross-section, but with a conical profile in their confronting surfaces. In this construction, the wall thickness of said tubular sleeve 20 ranges from a reduced thickness, adjacent to its lower end 22*a*, in which the inner diameter of said tubular sleeve 20 is the largest of this construction, to a greater wall thickness in the region of an upper end 21*a* of the upper portion 21 of the tubular sleeve 20, in which the inner diameter of said tubular sleeve 20 is the smallest of this construction. The variations of wall thickness and inner diameter of the tubular sleeve 20 are calculated so that they do not affect the pumping efficiency of the present oil pump.

The solution of a constant circular cross-section presents the advantage of presenting a better performance for the oil pumping, although presenting higher difficulty to obtain the components when these are made in plastic material. The construction in a conical profile has the advantage of more facility to obtain the component parts of the present oil pump when they are made in plastic material.

In a complementary form, the pump body 30 of the illustrated construction in FIG. 9 presents a conical profile having a larger diameter adjacent to its lower end 31, and a smaller diameter adjacent to its end 32, the diameter variation of said pump body 30 being gradual and continuous, as it occurs with the variation of the inner diameter of the tubular sleeve 20. It should be noted that the present solution further allows a stepped variation in at least one of the parts of inner diameter of the tubular sleeve 20 and outer diameter of the pump body 30, without impairing the pumping efficiency of the present pump.

According to the present invention, the tubular sleeve 20 presents an inner surface wall 23, in which is provided, from the lower end 22*a* of said tubular sleeve 20, at least one helical groove 24 defining, with an adjacent confronting outer surface portion of the pump body 30, lubricant oil ascending channels C which conduct oil from the oil reservoir 4 and pumped by the present oil pump to the parts with relative movement of the compressor. The pump body 30 is mounted in the interior of the tubular sleeve 20, so as to be freely displaced in the interior of the latter, in radial directions orthogonal to the crankshaft 10 and rotatively fixed in relation to the rotor 6.

Since the helical groove 24 is provided in the inner wall of the tubular sleeve 20, the oil pump of the present invention presents an effect of centrifugal force and mechanical dragging superior to that of the prior art oil pump constructions.

In order not to alter the oil flow being upwardly drawn, the oil channels, defined by the helical grooves 24 produced in the inner surface 23 of the tubular sleeve 20, can be dimensioned so that the thickness thereof varies proportionally to the thickness variation of at least one of the parts of tubular sleeve 20 and pump body 30.

According to the present invention, the tubular sleeve 20 must be attached to at least one of the parts of rotor 6 and crankshaft 10, so as to be rotated by rotation of said rotor 6, directly by the movement thereof or by rotation of the crankshaft 10.

In a way of carrying out the present invention, such as illustrated in FIGS. 1-8, the tubular sleeve 20 is attached to the crankshaft 10, as described ahead, said crankshaft 10 presenting a tubular lower end portion 14, inside which is mounted the upper portion 21 of the tubular sleeve 20.

In the embodiment of the present invention illustrated in FIGS. 9-12, the tubular sleeve 20 is directly affixed to the rotor 6, although maintaining its upper portion 21 mounted in the interior of the tubular lower end portion 14 of the crankshaft 10.

While not illustrated, it should be understood that the present invention is not limited to a construction of crankshaft 10 internally mounting part of the tubular sleeve 20. The present solution is applied to constructions in which the tubular sleeve 20 may not be fitted in the interior of a tubular lower end portion 14 of the crankshaft 10. Besides, the present solution is also applied to constructions in which the crankshaft 10 externally affixes the tubular sleeve 20 of the oil pump, independent of the mounting arrangement of said tubular sleeve 20 in relation to the crankshaft 10.

In the constructions in which the crankshaft 10 does no present a tubular lower end portion 14, the tubular sleeve 20 can be mounted concentrical to the crankshaft 10, but externally thereto or also receiving, in an upper tubular portion defined in said tubular sleeve 20, an adjacent lower portion of said crankshaft 10.

Although the illustrated construction of tubular sleeve 20 and pump body 30 presents each of said parts formed in a single piece, it should be understood that both the tubular sleeve 20 and the pump body 30 can be provided by a plurality of pieces to be mounted to each other, each assembly of the plurality of pieces forming the desired length for the respective part of tubular sleeve 20 and of pump body 30.

According to a constructive form illustrated in FIGS. 1-8, the tubular sleeve 20 of the present oil pump externally carries, in its upper portion 21, a positioning stop 25, to be seated against an adjacent portion of the crankshaft 10, limiting the relative axial positioning between the tubular sleeve 20 and the tubular lower end portion 14 of the crankshaft 10. For this embodiment of the present invention, the positioning stop 25 limits the introduction of the upper portion 21 of the tubular sleeve 20 in the interior of the tubular lower end portion 14 of the crankshaft 10.

In this illustrated constructive option, the positioning stop 25 has the form of an annular peripheral flange 25*a*, externally provided in the upper portion 21 of the tubular sleeve 20, for example, incorporated in a single piece thereto.

In the illustrated construction, the peripheral flange 25*a* is seated against an adjacent stop face of the tubular lower end portion 14 of the crankshaft 10, in a condition in which the upper portion 21 of the tubular sleeve 20 is mounted in the interior of the tubular lower end portion 14 of the crankshaft 10. It should be understood that the condition in which the tubular sleeve 20 is mounted to the crankshaft 10 may be obtained by seating and affixing said peripheral flange 25*a* against an adjacent end face of the lower end 12 of the crankshaft 10, in the condition in which said tubular sleeve 20 is mounted to said crankshaft 10.

In a particular construction of the present invention, illustrated in the enclosed drawings, the peripheral flange 25*a* is annular and continuous, being provided around the whole periphery of the tubular sleeve 20. However, it should be understood that said peripheral flange 25*a* may be provided occupying only part of the peripheral extension of the tubular sleeve 20, or also provided in the form of flange segments around part or the whole of said peripheral extension of the tubular sleeve 20.

In another possible construction, the peripheral flange 25*a* is not incorporated to the tubular sleeve 20, and may be, for example, retained therein by an appropriate means, such as thread, fitting, glue, etc., permitting a desired adjustment for the introduction of the upper portion 21 inside the tubular lower end portion 14 of the crankshaft 10, particularly permitting the adjustment of the distance of the upper end 21*a* of said upper portion 21 of the tubular sleeve 20 in relation to an inner wall 14*a* of the tubular lower end portion 14 of the crankshaft 10 and which defines the innermost portion thereof.

The present oil pump further comprises retaining means 40, which affix the tubular sleeve 20 to at least one of the parts of rotor 6 and crankshaft 10, as described ahead.

For the construction illustrated in FIGS. 1-9, and in which the tubular sleeve 20 is attached to the crankshaft 10, the retaining means 40 comprise an inner thread 41, provided in an inner surface portion of the tubular lower end portion 14 of the crankshaft 10, to be engaged in an outer thread 42 provided in the upper portion 21 of the tubular sleeve 20, in an adjacent confronting portion of the outer surface of the latter, each of said inner thread 41 and outer thread 42 being defined along an extension of the respective surface in which it is provided.

It should be understood that the retaining means 40 may present other constructive forms for affixing the tubular sleeve 20 to the crankshaft 10, such as rivet, glue, mechanical interference, flexible fingers, external screwing, injection of the component in the shaft itself, etc., these constructive options not being limitative of the present invention.

Figure 10:
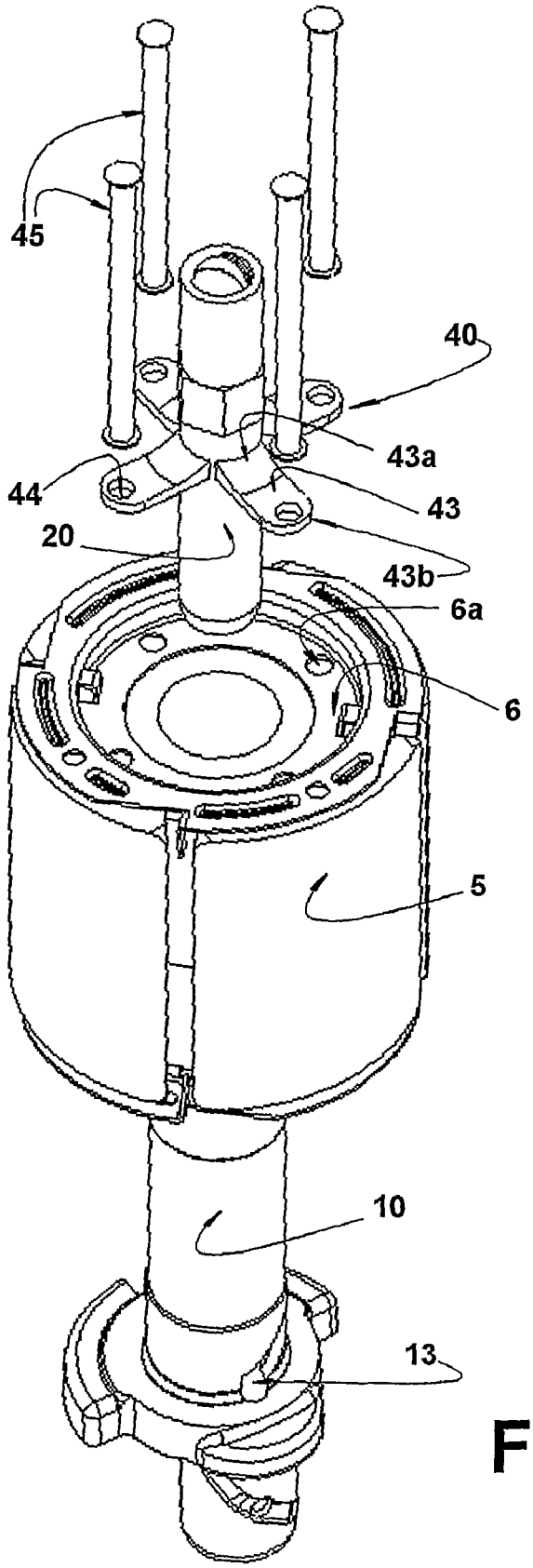
FIG. 10 represents a schematic lower exploded perspective view of a tubular sleeve of another construction for the oil pump of the present invention, before its attachment to the rotor of the compressor and before mounting it to the crankshaft of the latter.
Figure 11:
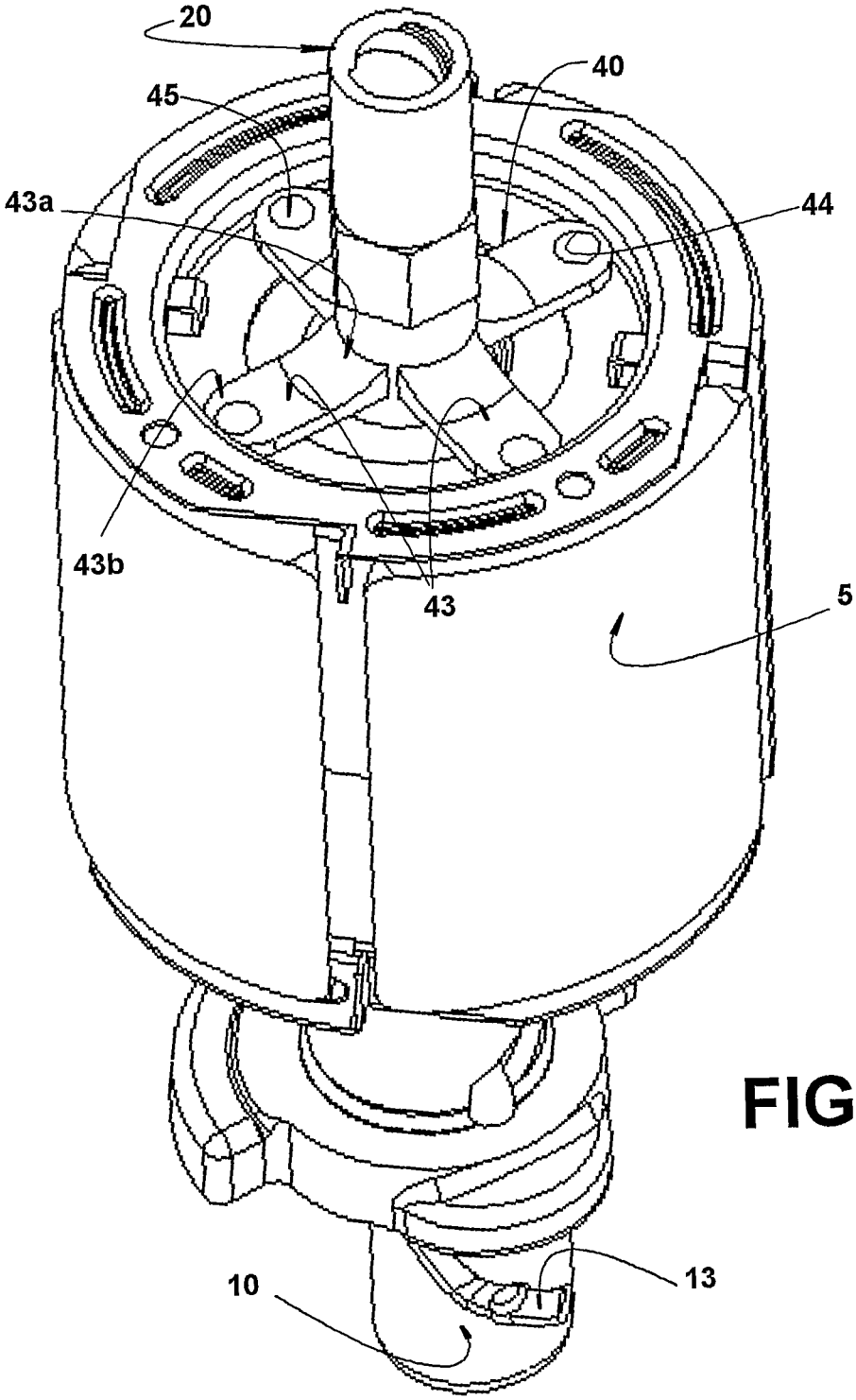
FIG. 11 represents a schematic perspective view of the tubular sleeve illustrated in FIG. 10, after its fixation to the rotor of the compressor.
Figure 12:
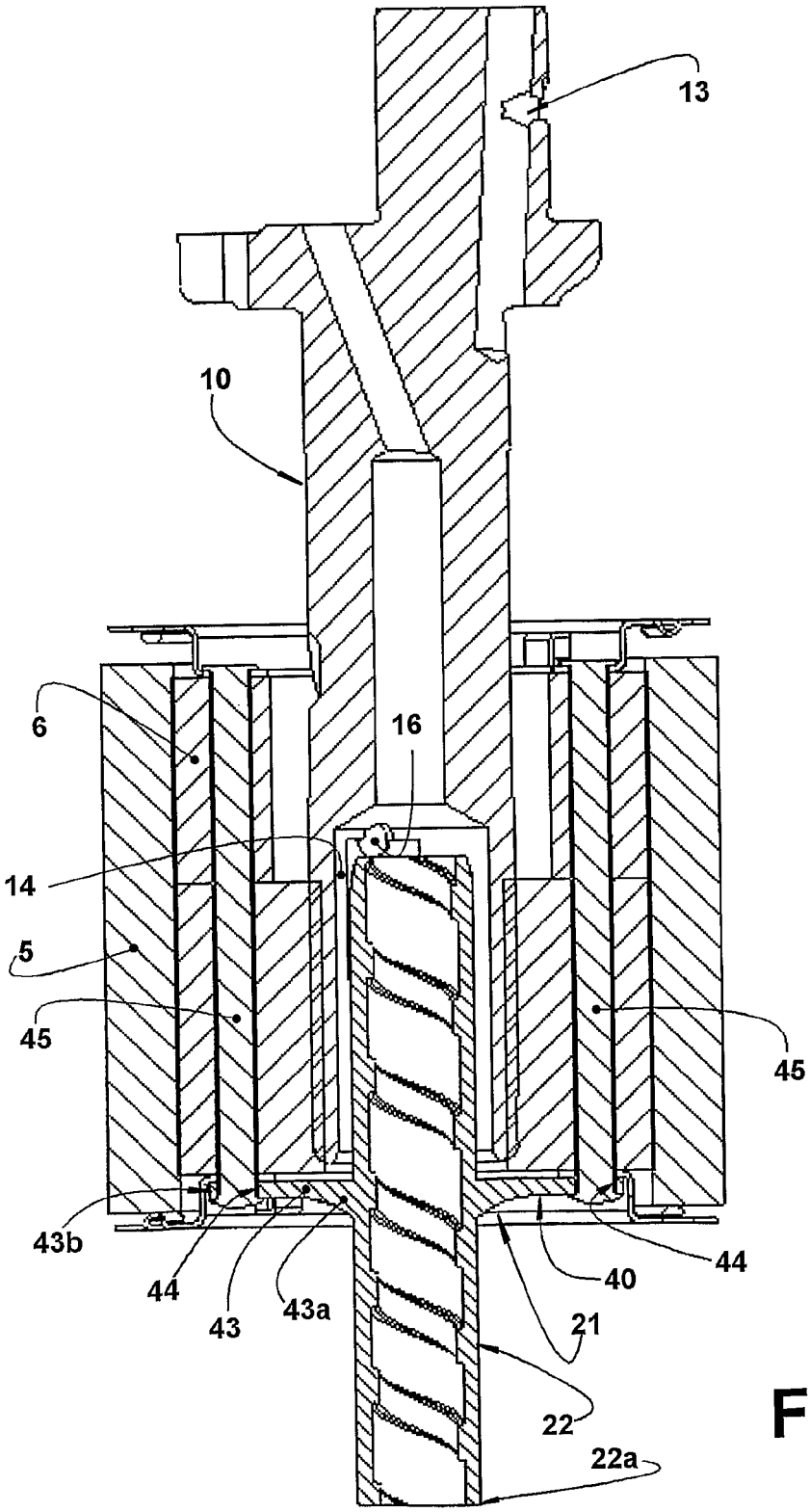
FIG. 12 represents a schematic longitudinal sectional view of the oil pump construction illustrated in FIG. 11 in which the tubular sleeve of said oil pump is partially mounted in the interior of the crankshaft and attached to the electric motor rotor of the compressor.

In the constructive option illustrated in FIGS. 10-12, the tubular sleeve 20 is directly and concentrically attached to the rotor 6, through retaining means 40 provided in at least one of the parts of tubular sleeve 20 and rotor 6, so as to actuate in the other of said parts, affixing them to each other.

In a way of carrying out the present invention, the present oil pump comprises at least one retaining element 43, radially disposed and having an end 43*a* affixed in one of the parts of tubular sleeve 20 and rotor 6 and another end 43*b* affixed to the other of said parts.

In a particular form of this solution, at least one retaining element 43 has one of its ends incorporated, in a single piece, to the tubular sleeve 20, the other end being seated and affixed against an adjacent end face of the rotor 6, by at least one of the means defined by screws, glue, rivets, clamps, etc.

In the constructive form illustrated in FIGS. 10-12, the tubular sleeve 20 incorporates, in a single piece, from its upper portion 21, two pairs of retaining elements 43, in the form of radial projections disposed around the tubular sleeve 20 to prevent force resultants from acting thereon.

Each retaining element 43 has its other end 43*b* radially spaced from the surface of the tubular sleeve 20 and seated against an adjacent end face of the rotor 6, in a condition in which the tubular sleeve 20 is mounted to the latter, so as to allow the fixation of said tubular sleeve 20 to the rotor 6.

Each retaining element 43 is fixed to the rotor 6 by at least one of the means defined by screws, glue, rivets, clamps, mechanical interference, flexible fingers, etc.

In the construction illustrated in FIGS. 10-12, the retaining elements 40 are symmetrically distributed around the outer surface of the tubular sleeve 20, each presenting a respective retaining hole 44 provided in the other end 43*b* of each respective retaining element 43.

Upon mounting the tubular sleeve to the rotor 6 of this construction, each retaining element 42 is conducted to a mounting position to the rotor 6, so that each retaining hole 44 is aligned with a retaining channel 6*a* produced in the rotor 6, to allow the passage of a respective rivet or retaining screw 45, affixing the tubular sleeve 20 to the rotor 6.

In this construction, the retaining elements 42 define a stop means for introduction of the tubular sleeve 20 inside the tubular lower end portion 14 of the crankshaft 10.

The construction of retaining means 40 in the form illustrated in FIGS. 1-9, or in the form illustrated in FIGS. 10-12 of the enclosed drawings is defined as a function of the characteristics of the compressor in which the oil pump will be mounted. For compressors presenting a crankshaft 10 already provided with an inner thread portion defined in the tubular end portion 14 of said crankshaft 10, such as illustrated in FIGS. 1-9, (as it occurs in the compressors EG), the provision of the retaining means 40 in the form of helical thread is more appropriate. However, regarding the compressor constructions which do not present inner thread in the tubular end portion 14 of the crankshaft 10, as is the case of compressors EM, the retaining means 40 can present other constructions, such as that illustrated in FIGS. 10-12. It should be understood, however, that the constructions of retaining means 40 described and illustrated herein should not be considered as limitative of the concept of affixing the tubular sleeve 20 to at least one of the parts of crankshaft 10 and rotor 6.

In a constructive option in which the tubular sleeve 20 is externally affixed to the crankshaft 10, the retaining means may also have the form of cooperating threads, one of which provided, for example, in the peripheral flange 25*a* and the other provided in the adjacent end portion 12 of the crankshaft 10. In another constructive form of retaining means within the concept presented herein, this can be defined by an annular flange mounted to the tubular sleeve 20 and to be seated against the rotor 6, or also in the form of a projection affixed to the rotor 6 and presenting an eye through which is fitted and affixed the tubular sleeve 20.

The mounting of the pump body 30 in the interior of the tubular sleeve 20 is carried out so that an upper end portion 32 of the pump body 30 is maintained with a certain axial spacing in relation to the interior of the tubular end portion 14 of the crankshaft 10, said axial spacing being particularly defined in relation to an adjacent inner wall portion 14*a* of the crankshaft 10. This axial spacing defines a passage chamber 16 in the interior of the crankshaft 10, to which is opened an upper end 24*a* of each helical groove 24 of each lubricant oil ascending channel C, permitting the fluid communication between the lubricant oil of the oil reservoir 4 and said passage chamber 16. In some constructions, the passage chamber 16 is also defined in the interior of the tubular sleeve 20, adjacent to the upper end 21 of the latter. In a construction of the present invention, the passage chamber 16 maintains fluid communication with the oil outer channel 13 of the crankshaft 10, conducting lubricant oil to the compressor parts to be lubricated. In this construction, the crankshaft 10 defines an auxiliary reservoir in which is deposited the oil pumped from the oil reservoir 4, wherefrom it is pumped, through oil channels provided in the crankshaft 10, to the compressor parts away from the oil reservoir 4. In a particular variant of this construction, the oil reservoir is defined internal to the crankshaft 10.

In another embodiment of the present invention, the upper end 24*a* of each helical groove 24 is radially and directly open to the oil outer channel 13 of the crankshaft 10. In this case, the oil pumped from the oil reservoir 4 is directly conducted to the oil outer channel 13 of the crankshaft 10.

According to the present invention, the fixation of the pump body 30 to one of the parts of shell 1, cylinder block 2, and stator 5 is effected through a supporting means 50 having a first portion 51, which carries a lower end portion 31 of the pump body 30, and a second portion 52, through which the supporting means 50 is mounted to one of said parts of shell 1, cylinder block 2, and stator 5.

According to the present invention, the parts defined by the lower end portion 31 of the pump body 30 and by the first portion 51 of the supporting means 50 are loosely fitted to each other, so that the pump body 30 can be freely displaced in radial directions orthogonal to the crankshaft 10.

In the illustrated constructive form, the supporting means 50 comprises a rigid rod 50*a* having the first portion 51 loosely fitted in a radial housing 33 provided in the lower end portion 31 of the pump body 30, so as to support the latter.

In a way of carrying out the present invention, the rigid rod 50*a* is constructed in plastic material. The construction of the rigid rod 50*a* in plastic material facilitates the manufacture of this component. Furthermore, the construction in plastic material also minimizes heat transfer from the crankshaft 10 to the oil being pumped, as a function of the low thermal conductivity of said material.

According to the illustrated appended figures, the lower end portion 31 of the pump body 30 defines a widened base provided with the radial housing 33, which is in the form of a diametral through hole presenting an upper face 33*a* which seats onto the first portion 51 of the rigid rod 50*a*, and a lower face 33*b*, axially spaced from the first portion 51 of the rigid rod 50*a* by a value lower than that of the axial distance between the upper end portion 32 of the pump body 30 and the inner wall 14*a* of the tubular end portion 14 of the crankshaft 10, so as to prevent impacts between said parts, during operation or displacements of the compressor.

In the illustrated construction, the rigid rod 50*a* presents a double L-shaped profile, having two consecutive and continuous "L" portions, the two "L" portions of said rigid rod 50*a* being, in the illustrated construction, interconnected with at least one structural rib 53 between a base portion of one of the "L" portions and an adjacent elevated portion of another of said "L" portions.

It should be understood that the provision of the structural rib 53, which is a particular illustrated construction, should not be limitative. In another embodiment of the present invention, the "L" portions are provided in a single piece formed in a sufficiently resistant material, so as not to require the provision of a structural rib.

According to the present invention, one of the "L" portions presents its respective elevated portion affixed to one of the parts of shell 1, cylinder block 2 and stator 5 and, the other "L" portion presents its respective base portion fitted in the radial slot 33 of the pump body 30. In the illustrated construction, a first "L" portion has its respective base portion fitted in the radial slot 33 of the pump body 30 and is disposed inferiorly to a second "L" portion, which is provided, in its respective elevated portion, with fixation means 54, for example, in the form of fingers 54*a* which are elastically deformed to be affixed to the stator 5, particularly to a stator cover 60 of known construction and usually mounted in a lower end of the stator, turned to the oil reservoir 4.

According to the present invention, while a particular construction of fixation rod 50*a* has been described, it should be understood that the rod can present any profile which guarantees the desired rigidity, its fixation to the stator 5 being carried out by other fixation means 54 besides that illustrated in the form of fingers 54*a*, said fixation means 54 being, for example, glue, screw, rivet, clamps, quick fitting ("snap-on"), welding, etc.

Although the concept presented herein has been described mainly considering the oil pump construction illustrated, it should be understood that this particular construction does not restrict the applicability or scope of the present invention. The intention is to protect the principle and not the specific application or constructive form.

It should be understood that for any of the possible options for constructing and mounting the tubular sleeve 20 to the rotor and/or to the crankshaft 10 (internal or external to this), as well as the provision and construction of the retaining means 40, the oil pump of the present invention presents its pump body affixed to one of the parts of shell 1, cylinder block 2 and stator 3 with a supporting means, as cited above and which, for example, presents the construction described and illustrated herein, but which should not be considered as limitative of the presented concept.

The invention claimed is:

1. An oil pump for a refrigerating compressor presenting a shell comprising in its interior:

an oil reservoir containing lubricant oil and carrying a cylinder block affixing the stator of a motor provided with a rotor which rotates a crankshaft carrying, in a lower end; and an oil pump immersed in the lubricant oil, comprising:

a tubular sleeve, having an upper portion affixed to at least one of the parts of crankshaft and rotor, so as to rotate therewith;

a lower portion having a lower end immersed in the lubricant oil, said tubular sleeve being provided with an inner surface presenting, along at least part of its longitudinal extension, at least one helical groove upwardly extending from the lower end; and an elongated pump body, disposed in the interior of the tubular sleeve, maintaining a certain radial gap in relation to the latter and having an outer surface defining, with the adjacent helical groove of the tubular sleeve, a lubricant oil ascending channel, said pump body presenting a lower end portion projecting beyond the lower end of the tubular sleeve and mounting means mounting the lower end of said pump body to one of the parts of shell, cylinder block, and stator, so as to be freely displaced in the interior of the tubular sleeve, in radial directions orthogonal to the crankshaft and rotatively locked in relation to the rotor.

2. The oil pump, as set forth in claim 1, wherein the crankshaft presents a tubular lower end portion inside which is mounted the upper portion of the tubular sleeve.

3. The oil pump, as set forth in claim 2, wherein the tubular sleeve is concentrically affixed to the crankshaft.

4. The oil pump, as set forth in claim 3, wherein the tubular lower end portion of the crankshaft is provided with an inner thread, to be coupled by an outer thread provided in the upper portion of the tubular sleeve.

5. The oil pump, as set forth in claim 2, wherein the tubular sleeve is directly and concentrically affixed to the rotor.

6. The oil pump, as set forth in claim 2, the tubular sleeve externally carries, in its upper portion, a positioning stop to be seated against the tubular lower end portion of the crankshaft, limiting the relative axial positioning between the tubular sleeve and the tubular lower end portion of the crankshaft.

7. The oil pump, as set forth in claim 6, wherein the positioning stop comprises a peripheral flange incorporated, in a single piece, to the upper portion of the tubular sleeve.

8. The oil pump, as set forth in claim 1, wherein it comprises a supporting means having a first portion carrying the lower end portion of the pump body and a second portion, through which the supporting means is mounted to one of the parts of shell, cylinder block and stator.

9. The oil pump, as set forth in claim 1, wherein the parts of tubular sleeved and pump body present a circular cross-section.

10. The oil pump, as set forth in claim 9, wherein the parts of tubular sleeve and pump body present a constant cross-section.

11. The oil pump, as set forth in claim 1, wherein the pump body and the tubular sleeve are made in plastic material.

12. The oil pump, as set forth in claim 1, wherein the tubular sleeve is in a single piece and the pump body is made in a single piece.

13. The oil pump, as set forth in claim 1, wherein the tubular sleeve is directly and concentrically affixed to the rotor.

14. An oil pump for a refrigerating compressor presenting a shell comprising in its interior;

an oil reservoir containing lubricant oil and carrying a cylinder block affixing the stator of a motor provided with a rotor which rotates a crankshaft carrying, in a lower end; and an oil pump immersed in the lubricant oil, comprising:

a tubular sleeve, having an upper portion affixed to at least one of the parts of crankshaft and rotor, so as to rotate therewith;

a lower portion having a lower end immersed in the lubricant oil, said tubular sleeve being provided with an inner surface presenting, along at least part of its longitudinal extension, at least one helical groove upwardly extending from the lower end;

an elongated pump body, disposed in the interior of the tubular sleeve, maintaining a certain radial gap in relation to the latter and having an outer surface defining, with the adjacent helical groove of the tubular sleeve, a lubricant oil ascending channel, said pump body presenting a lower end portion projecting beyond the lower end of the tubular sleeve and through which said pump body is mounted to one of the parts of shell, cylinder block, and stator, so as to be freely displaced in the interior of the tubular sleeve, in radial directions orthogonal to the crankshaft and rotatively locked in relation to the rotor;

said crankshaft presents a tubular lower end portion inside which is mounted the upper portion of the tubular sleeve;

said tubular sleeve is directly and concentrically affixed to the rotor; and at least one retaining element dispensed radially and having an end affixed in one of the parts of said tubular sleeve and said rotor and another end affixed to the other of said parts.

15. The oil pump, as set forth in claim 14, wherein the retaining element has an end incorporated, in a single piece, to the tubular sleeve and the other end seated and affixed against an adjacent end face of the rotor.

16. The oil pump, as set forth in claim 15, wherein the retaining element is affixed to the rotor by at least one of the means defined by screws, glue, rivets, clamps.

17. An oil pump for a refrigerating compressor presenting a shell comprising in its interior;

an oil reservoir containing lubricant oil and carrying a cylinder block affixing the stator of a motor provided with a rotor which rotates a crankshaft carrying, in a lower end; and an oil pump immersed in the lubricant oil, comprising:

a tubular sleeve, having an upper portion affixed to at least one of the parts of crankshaft and rotor, so as to rotate therewith;

a lower portion having a lower end immersed in the lubricant oil, said tubular sleeve being provided with an inner surface presenting, along at least part of its longitudinal extension, at least one helical groove upwardly extending from the lower end;

an elongated pump body, disposed in the interior of the tubular sleeve, maintaining a certain radial gap in relation to the latter and having an outer surface defining, with the adjacent helical groove of the tubular sleeve, a lubricant oil ascending channel, said pump body presenting a lower end portion projecting beyond the lower end of the tubular sleeve and through which said pump body is mounted to one of the parts of shell, cylinder block, and stator, so as to be freely displaced in the interior of the tubular sleeve, in radial directions orthogonal to the crankshaft and rotatively locked in relation to the rotor; and said crankshaft being provided, in its outer surface, with at least one oil outer channel wherein the helical groove of the tubular sleeve presents an upper end opened to the oil outer channel of the crankshaft.

18. The oil pump, as set forth in claim 17, wherein the upper end of the helical groove is radially and directly opened to the oil outer channel of the crankshaft.

19. The oil pump, as set forth in claim 17, wherein the upper end of the helical groove is opened to a passage chamber defined in the crankshaft, in fluid communication with the oil outer channel thereof.

20. The oil pump, as set forth in claim 19, wherein the passage chamber is defined in the interior of the crankshaft, between the upper end portion of the pump body and the interior of the tubular lower end portion of the crankshaft.

21. An oil pump for a refrigerating compressor presenting a shell comprising in its interior;

an oil reservoir containing lubricant oil and carrying a cylinder block affixing the stator of a motor provided with a rotor which rotates a crankshaft carrying, in a lower end; and an oil pump immersed in the lubricant oil, comprising:

a tubular sleeve, having an upper portion affixed to at least one of the parts of crankshaft and rotor, so as to rotate therewith;

a lower portion having a lower end immersed in the lubricant oil, said tubular sleeve being provided with an inner surface presenting, along at least part of its longitudinal extension, at least one helical groove upwardly extending from the lower end;

an elongated pump body, disposed in the interior of the tubular sleeve, maintaining a certain radial gap in relation to the latter and having an outer surface defining, with the adjacent helical groove of the tubular sleeve, a lubricant oil ascending channel, said pump body presenting a lower end portion projecting beyond the lower end of the tubular sleeve and through which said pump body is mounted to one of the parts of shell, cylinder block, and stator, so as to be freely displaced in the interior of the tubular sleeve, in radial directions orthogonal to the crankshaft and rotatively locked in relation to the rotor;

a supporting means having a first portion carrying the lower end portion, the pump body and a second portion through which the supporting means is mounted to one of the parts of shell cylinder block and stator; and the parts defined by the lower end portion of the pump body and by the first portion of the supporting being loosely fitted to each other, so that the pump body can be freely displaced in radial directions orthogonal to the crankshaft.

22. The oil pump, as set forth in claim 21, wherein the supporting means comprises a rigid rod having the first portion loosely fitted in a radial housing provided in the lower end portion of the pump body, so as to support the latter.

23. The oil pump, as set forth in claim 22, and with the crankshaft comprising:

a tubular lower end portion having an inner wall, wherein the radial housing presents an upper face which seats onto the first portion of the rigid rod, and a lower face axially spaced from the first portion of the rigid rod, by a value lower than that of the distance between an upper end portion of the pump body and the inner wall at of the tubular end portion of the crankshaft.

24. The oil pump, as set forth in claim 23, wherein the lower end portion of the pump body defines a widened base provided with the radial housing.

25. The oil pump, as set forth in claim 24, wherein the radial housing is in the form of a diametral through hole.

26. The oil pump, as set forth in claim 22, wherein the rigid rod has the second portion mounted to the stator.

27. The oil pump, as set forth in claim 22, wherein the rigid rod presents a double "L"-shaped profile.

28. The oil pump, as set forth in claim 27, wherein the second "L" portion of the rigid rod is provided with fixation means for affixing said rigid rod to the stator.

29. The oil pump, as set forth in claim 22, wherein the rigid rod is made in plastic material.

30. An oil pump for a refrigerating compressor presenting a shell comprising in its interior;

an oil reservoir containing lubricant oil and carrying a cylinder block affixing the stator of a motor provided with a rotor which rotates a crankshaft carrying, in a lower end; and an oil pump immersed in the lubricant oil, comprising:

a tubular sleeve, having an upper portion affixed to at least one of the parts of crankshaft and rotor, so as to rotate therewith;

a lower portion having a lower end immersed in the lubricant oil, said tubular sleeve being provided with an inner surface presenting, along at least part of its longitudinal extension, at least one helical groove upwardly extending from the lower end;

an elongated pump body, disposed in the interior of the tubular sleeve, maintaining a certain radial gap in relation to the latter and having an outer surface defining, with the adjacent helical groove of the tubular sleeve, a lubricant oil ascending channel, said pump body presenting a lower end portion projecting beyond the lower end of the tubular sleeve and through which said pump body is mounted to one of the parts of shell, cylinder block, and stator, so as to be freely displaced in the interior of the tubular sleeve, in radial directions orthogonal to the crankshaft and rotatively locked in relation to the rotor;

the parts of the tubular sleeve and the pump body a constant cross-section; and the parts of tubular sleeve and the pump body present a respective surface confronting with the surface of the other part, said confronting surfaces having a conical profile.

31. An oil pump for a refrigerating compressor presenting a shell comprising in its interior;

an oil reservoir containing lubricant oil and carrying a cylinder block affixing the stator of a motor provided with a rotor which rotates a crankshaft carrying, in a lower end; and an oil pump immersed in the lubricant oil, comprising:

a tubular sleeve, having an upper portion affixed to at least one of the parts of crankshaft and rotor, so as to rotate therewith;

a lower portion having a lower end immersed in the lubricant oil, said tubular sleeve being provided with an inner surface presenting, along at least part of its longitudinal extension, at least one helical groove upwardly extending from the lower end;

an elongated pump body, disposed in the interior of the tubular sleeve, maintaining a certain radial gap in relation to the latter and having an outer surface defining, with the adjacent helical groove of the tubular sleeve, a lubricant oil ascending channel, said pump body presenting a lower end portion projecting beyond the lower end of the tubular sleeve and through which said pump body is mounted to one of the parts of shell, cylinder block, and stator, so as to be freely displaced in the interior of the tubular sleeve, in radial directions orthogonal to the crankshaft and rotatively locked in relation to the rotor;

said tubular sleeve being directly and concentrically affixed to said rotor; and at least one rotating element disposed radially and having an end affixed to one of the parts of the tubular sleeve and the rotor and an opposite end affixed to the other of said parts.

32. The oil pump, as set forth in claim 31, wherein the rotating element has an end incorporated, in a single piece, to the tubular sleeve and the other end seated and affixed against an adjacent end face of the rotor.

33. The oil pump, as set forth in claim 32, wherein the rotating element is affixed to the rotor by at least one of the means defined by screws, glue, rivets, clamps.

* * * * *